US008281610B2

(12) United States Patent
Kim et al.

(10) Patent No.: US 8,281,610 B2
(45) Date of Patent: Oct. 9, 2012

(54) ICE-MAKING DEVICE FOR REFRIGERATOR

(75) Inventors: Myung-Soo Kim, Gimhae (KR); Yoon-Min Park, Jinju (KR); Oh-Chul Kwon, Gimhae (KR); Jong-Gon Kim, Changwon (KR); Bon-Young Koo, Changwon (KR); Young-Hoon Gwak, Busan (KR); Hyeon-Po Cho, Busan (KR)

(73) Assignee: LG Electronics Inc., Seoul (KR)

( * ) Notice: Subject to any disclaimer, the term of this patent is extended or adjusted under 35 U.S.C. 154(b) by 385 days.

(21) Appl. No.: 12/160,732

(22) PCT Filed: Apr. 18, 2007

(86) PCT No.: PCT/KR2007/001895

§ 371 (c)(1),
(2), (4) Date: Nov. 7, 2008

(87) PCT Pub. No.: WO2007/120015

PCT Pub. Date: Oct. 25, 2007

(65) Prior Publication Data

US 2009/0064703 A1 Mar. 12, 2009

(30) Foreign Application Priority Data

Apr. 18, 2006 (KR) ..... 10-2006-0035107
Apr. 18, 2006 (KR) ..... 10-2006-0035110
Apr. 18, 2006 (KR) ..... 10-2006-0035122

(51) Int. Cl.
*F25C 1/22* (2006.01)
*F25C 5/18* (2006.01)
*F25D 19/00* (2006.01)

(52) U.S. Cl. ..... 62/344; 62/340; 62/449

(58) Field of Classification Search ..... 62/344, 62/449

See application file for complete search history.

(56) References Cited

U.S. PATENT DOCUMENTS 4,997,109 A * 3/1991 Carper ..... 222/146.6
6,050,097 A * 4/2000 Nelson et al. ..... 62/137
6,442,954 B1 9/2002 Shapiro et al.
7,469,553 B2 * 12/2008 Wu et al. ..... 62/344
2006/0086130 A1 4/2006 Anselmino et al.
2006/0213213 A1 * 9/2006 Chung et al. ..... 62/344

FOREIGN PATENT DOCUMENTS

AU 2005225155 A1 5/2006

(Continued)

*Primary Examiner* — Frantz Jules
*Assistant Examiner* — Daniel C Comings
(74) *Attorney, Agent, or Firm* — Birch, Stewart, Kolasch & Birch, LLP

(57) ABSTRACT

An ice-making device for a refrigerator includes an ice maker for making ice, which is provided on a backside of a door of the refrigerator; and an ice maker cover for selectively opening or closing the ice maker. Fixing recesses are formed to be open downwardly on outsides of both sides of the ice maker cover, and receive fixing protrusions provided at corresponding positions on opposite sides of a pair of support steps that protrude rearward from both side ends of the backside of the door by a predetermined length and are formed to be elongated in an up and down direction. Play prevention steps are provided at lower ends of both sides of the ice maker cover and are seated on play prevention ribs provided to be elongated in a horizontal direction at corresponding positions of the opposite sides of the support steps below the fixing protrusions.

17 Claims, 8 Drawing Sheets

FOREIGN PATENT DOCUMENTS

| | | | |
|---|---|---|---|
| JP | 6-11228 | A | 1/1994 |
| JP | 2003-106735 | A | 4/2003 |
| JP | 2005-9784 | A | 1/2005 |
| KR | 10-2005-0077558 | A | 8/2005 |
| KR | 10-2005-0094672 | A | 9/2005 |
| KR | 10-2005-0110212 | A | 11/2005 |
| KR | 10-2007-0096374 | A | 10/2007 |
| KR | 10-2007-0096375 | A | 10/2007 |
| KR | 10-2007-0096376 | A | 10/2007 |
| KR | 10-2007-0096377 | A | 10/2007 |
| RU | 3638 | U1 | 2/1997 |
| WO | WO 2007/108662 | A1 | 9/2007 |

* cited by examiner

ICE-MAKING DEVICE FOR REFRIGERATOR

TECHNICAL FIELD

The present invention relates to a refrigerator, and more particularly, to an ice-making device for a refrigerator that is installed on a backside of a door to make ice.

BACKGROUND ART

FIG. 1 illustrates a main portion of a refrigerator provided with a conventional ice-making device.

As illustrated in the figure, an inner case 12 is coupled to the inside of an outer case 11 defining the external appearance of a refrigerator main body 10. The inner case 12 is to define the inside of the main body 10, and a freezing chamber 13 that is a storage space is substantially defined by the inner case 12.

Provided on one side of the main body 10 is a door 15 for selectively opening or closing the freezing chamber 13. The door 15 is installed to the main body 10 to be pivotable on one end thereof so that the other end thereof is moved in the fore and aft direction. The door IS includes an outer door 16 and a door liner 17. The outer door 16 defines the front external appearance of the door 15. Furthermore, the door liner 17 defines the backside external appearance of the door 15.

A shroud 19 is provided inside the freezing chamber 13. The shroud 19 is positioned to be spaced apart by a predetermined distance from the rear side of the freezing chamber 13. Furthermore, the shroud 19 is formed with a plurality of cold air discharge holes 19*a* through which cold air is discharged into the freezing chamber 13.

Meanwhile, a heat exchange chamber 21 is formed between the rear side of the freezing chamber 13 and the backside of the shroud 19. The lower part of the heat exchange chamber 21 is provided with an evaporator (not shown) for generating cold air. Furthermore, the upper part of the heat exchange chamber 21 is provided with an air-blowing fan 23 for discharging cold air, which is heat-exchanged in the evaporator, to the freezing chamber 13.

An ice maker 25 is provided in the upper part of the rear side of the freezing chamber 13 corresponding to the front of the air-blowing fan 23. The ice maker 25 is installed to extend from side to side on the upper part of the freezing chamber 13 adjacent to the shroud 19. The ice maker 25 serves to make ice and transfer it to an ice bank 31, which will be described later.

A motor casing 29 is installed on one side of the freezing chamber 13 below the ice maker 25. A feed motor 27 for driving a feed lever 31*a* to be described later is provided in the motor casing 29.

The ice bank 31 is provided in the freezing chamber 13 corresponding to the front of the motor casing 29. The ice bank 31 serves to transfer the ice received from the ice maker 25 to a dispenser (not shown) and to enable a user to take out the ice from the outside. To this end, the feed lever 31*a* driven by the feed motor 27 is provided in the ice bank 31. One end of the feed lever 31*a* is connected to a drive shaft of the feed motor 27.

However, the conventional refrigerator so configured has the following problems.

As described above, in the prior art, the ice maker 25 is installed on the rear side of the freezing chamber 13 to extend from side to side. Furthermore, in order to transfer the ice made in the ice maker 25 to the dispenser, the motor casing 29 and the ice bank 31 are respectively provided in the freezing chamber 13. Hence, there is a disadvantage in that a storage capacity of the freezing chamber 13 is reduced as much as the volumes of the ice maker 25, the motor casing 29 and the ice bank 31.

Furthermore, since the ice maker 25 is installed in the freezing chamber 13, the ice maker 25 makes ice by means of cold air circulating in the freezing chamber 13. Hence, in a process of making ice in the ice maker 25, smell of other food stored in the freezing chamber 13 can permeate the ice.

DISCLOSURE

Technical Problem

The present invention is conceived to solve the aforementioned problems in the prior art. An object of the present invention is to provide an ice-making device for a refrigerator that is configured to prevent the lowering of a storage capacity of a refrigerator.

Another object of the present invention is to provide an ice-making device for a refrigerator that is configured to minimize the phenomenon that smell of other food stored in the refrigerator permeates ice.

Technical Solution

According to an aspect of the present invention for achieving the objects, there is provided an ice-making device for a refrigerator, comprising an ice maker for making ice, which is provided on a backside of a door for selectively opening or closing a storage space of the refrigerator; and an ice maker cover detachably installed on the backside of the door so as to selectively open or close the ice maker. Here, fixing recesses are formed to be open downwardly on outsides of both sides of the ice maker cover, and receive fixing protrusions provided at corresponding positions on opposite sides of a pair of support steps that protrude rearward from both side ends of the backside of the door by a predetermined length and are formed to be elongated in an up and down direction. Further, play prevention steps are provided at lower ends of both sides of the ice maker cover, and are seated on play prevention ribs provided to be elongated in a horizontal direction at corresponding positions of the opposite sides of the support steps below the fixing protrusions.

A fastening hook may be further provided at a lower end of a backside of the ice maker cover adjacent to the backside of the door, wherein the fastening hook is elastically fastened to a connection step formed in such a manner that a portion of the backside of the door protrudes rearward by a predetermined length so as to laterally connect upper ends of the support steps.

The ice-making device may further comprise a cold air duct provided to be elongated in a fore and aft direction on a ceiling of the storage space so as to supply the ice maker with a portion of cold air supplied to the storage space; and an ice bank detachably installed on the backside of the door below the ice maker so as to store ice made in the ice maker and to transfer the ice to a dispenser provided on the door.

According to another aspect of the present invention, there is provided an ice-making device for a refrigerator, comprising an ice maker for making ice, which is provided on a backside of a door for selectively opening or closing a storage space of the refrigerator; an ice bank that is detachably installed on the backside of the door below the ice maker so as to store ice made in the ice maker, and has an ice-releasing means for transferring the ice to a dispenser provided on the door and an ice-crushing means for crushing the ice; a driving connector provided at one side of the backside of the door and rotated by a driving means for providing a driving force for use in operating the ice-releasing means and the ice-crushing means; and an interlocking connector provided at one side of a backside of the ice bank and rotated in cooperation with the rotation of the driving connector so as to transmit the driving force of the driving means to the ice-releasing means and the ice-crushing means, wherein a pair of interlocking protrusions having a cylindrical shape and protruding from the backside of the door are provided on the driving connector, and a pair of interlocking ribs respectively engaged with the interlocking protrusions are provided on the interlocking connector, whereby upon rotation of the driving connector, the interlocking connector is rotated by the interlocking protrusions and the interlocking ribs that are engaged with each other.

The ice-making device may further comprise a seating member installed in a space that is defined by the backside of the door, opposite sides of a pair of support steps protruding rearward from both side ends of the backside of the door by a predetermined length and formed to be elongated in an up and down direction, and a seating step formed to be elongated in a left and right direction in such a manner that a portion of the backside of the door between the support steps protrudes rearward by a predetermined length, wherein the seating member has an installation space in which the ice maker and the ice bank are installed, the driving means is a driving motor installed between the backside of the door and the seating step, and the driving connector and the interlocking connector are rotatably installed in installation recesses formed at one side of a front side of the installation space and a rear side of the ice bank.

The interlocking protrusion may protrude from one side of the front side of the installation space by a predetermined length, and the interlocking rib may be positioned in the installation recess of the ice bank.

The ice-making device may further comprise a cold air duct provided to be elongated in a fore and aft direction on a ceiling of the storage space so as to supply the ice maker with a portion of cold air supplied to the storage space; and an ice maker cover detachably installed on the backside of the door so as to selectively open and close the ice maker.

According to a further aspect of the present invention, there is provided an ice-making device for a refrigerator, comprising an ice maker for making ice, which is provided on a backside of a door for selectively opening or closing a storage space of the refrigerator; and a cold air duct provided at one side of the storage space so as to supply the ice maker with a portion of cold air supplied to the storage space, wherein an insulating material is provided in the cold air duct so as to prevent the inside of the cold air duct from being frozen by the cold air supplied to the ice maker.

Both ends of the cold air duct may be provided with a cold air inlet through which a portion of cold air to be supplied to the storage space is introduced and a cold air outlet through which cold air to be supplied to the ice maker is discharged, respectively, and the insulating material may be provided in the cold air duct between the cold air inlet and the cold air outlet.

The insulating material may be formed of a polyethylene foam material.

The ice-making device may further comprise an ice maker cover detachably installed on the backside of the door so as to selectively open and close the ice maker; and an ice bank detachably installed on the backside of the door below the ice maker so as to store ice made in the ice maker and to transfer the ice to a dispenser provided on the door.

According to a still further aspect of the present invention, there is provided an ice-making device for a refrigerator, comprising an ice maker for making ice, which is provided on a backside of a door for selectively opening or closing a storage space of the refrigerator; an ice maker cover detachably installed on the backside of the door so as to selectively open and close the ice maker; a cold air duct provided at one side of the storage space so as to supply the ice maker with a portion of cold air supplied to the storage space; and an ice bank detachably installed on the backside of the door below the ice maker so as to store ice made in the ice maker and to transfer the ice to a dispenser provided on the door. Here, fixing recesses are formed to be open downwardly on outsides of both sides of the ice maker cover, and receive fixing protrusions provided at corresponding positions on opposite sides of a pair of support steps that protrude rearward from both side ends of the backside of the door by a predetermined length and are formed to be elongated in an up and down direction. Further, a fastening hook is further provided at a lower end of a backside of the ice maker cover adjacent to the backside of the door, wherein the fastening hook is elastically fastened to a connection step formed in such a manner that a portion of the backside of the door protrudes rearward by a predetermined length so as to laterally connect upper ends of the support steps.

Play prevention steps may be provided at lower ends of both sides of the ice maker cover, wherein the play prevention steps are seated on play prevention ribs provided to be elongated in a horizontal direction at corresponding positions of the opposite sides of the support steps below the fixing protrusions.

An insulating material may be provided in the cold air duct so as to prevent the inside of the cold air duct from being frozen by the cold air supplied to the ice maker.

Both ends of the cold air duct may be provided with a cold air inlet through which a portion of cold air to be supplied to the storage space is introduced and a cold air outlet through which cold air to be supplied to the ice maker is discharged, respectively, and the insulating material may be provided in the cold air duct between the cold air inlet and the cold air outlet.

An auxiliary cold air outlet may be formed at one side of the cold air duct so that a portion of cold air in the cold air duct is discharged into the storage space therethrough.

The insulating material may be formed of a polyethylene foam material.

An ice-releasing means for transferring ice stored in the ice bank to the dispenser and an ice-crushing means for crushing the ice may be provided at one side of the ice bank, a driving connector rotated by a driving means may be provided at one side of the backside of the door, an interlocking connector for transmitting a driving force of the driving means to the ice-releasing means and the ice-crushing means in cooperation with the rotation of the driving connector may be provided at one side of the backside of the ice bank, and a pair of interlocking protrusions protruding from the driving connector may be engaged with interlocking ribs formed on the interlocking connector, so that the driving connector and the interlocking connector cooperate with each other.

The driving connector may be rotatably provided at one side of a seating member that is mounted on the backside of the door and defines an installation space in which the ice maker and the ice bank can be installed, the interlocking connector may be rotatably provided in an installation recess concavely formed on the backside of the ice bank, and the interlocking rib may be positioned in the installation recess.

Advantageous Effects

According to the ice-making device of the present invention so configured, there are advantages in that a storage capacity of a refrigerator can be used to the fill extent, smell of food can be prevented from permeating ice in a process of making ice, it is possible to improve durability of a product and to keep a refrigerator clean, and it is possible to prevent the occurrence of a phenomenon that a user is damaged by a product.

BEST MODE

Hereinafter, preferred embodiments of an ice-making device for a refrigerator according to the present invention will be described in detail with reference to the accompanying drawings.

Figure 1:
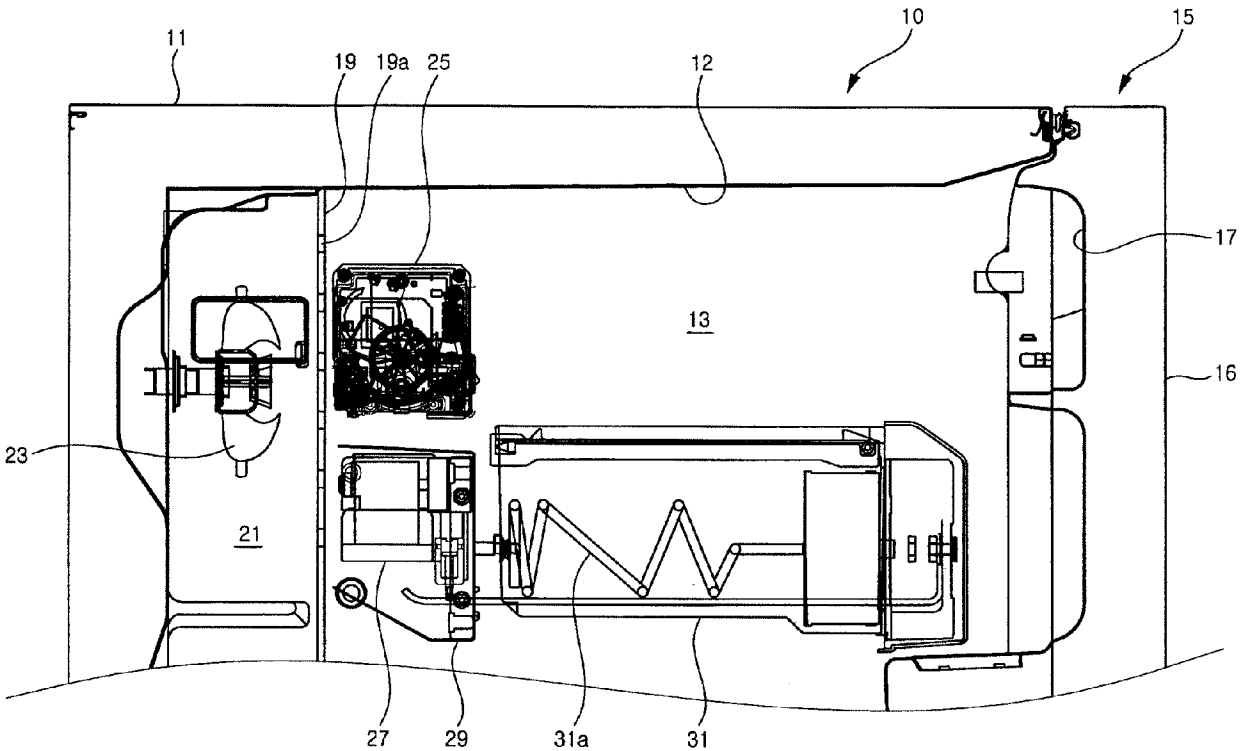
Fig. 1 Prior Art
FIG. 1 is a side sectional view illustrating a main portion of a refrigerator provided with a conventional ice-making device.
Figure 2:
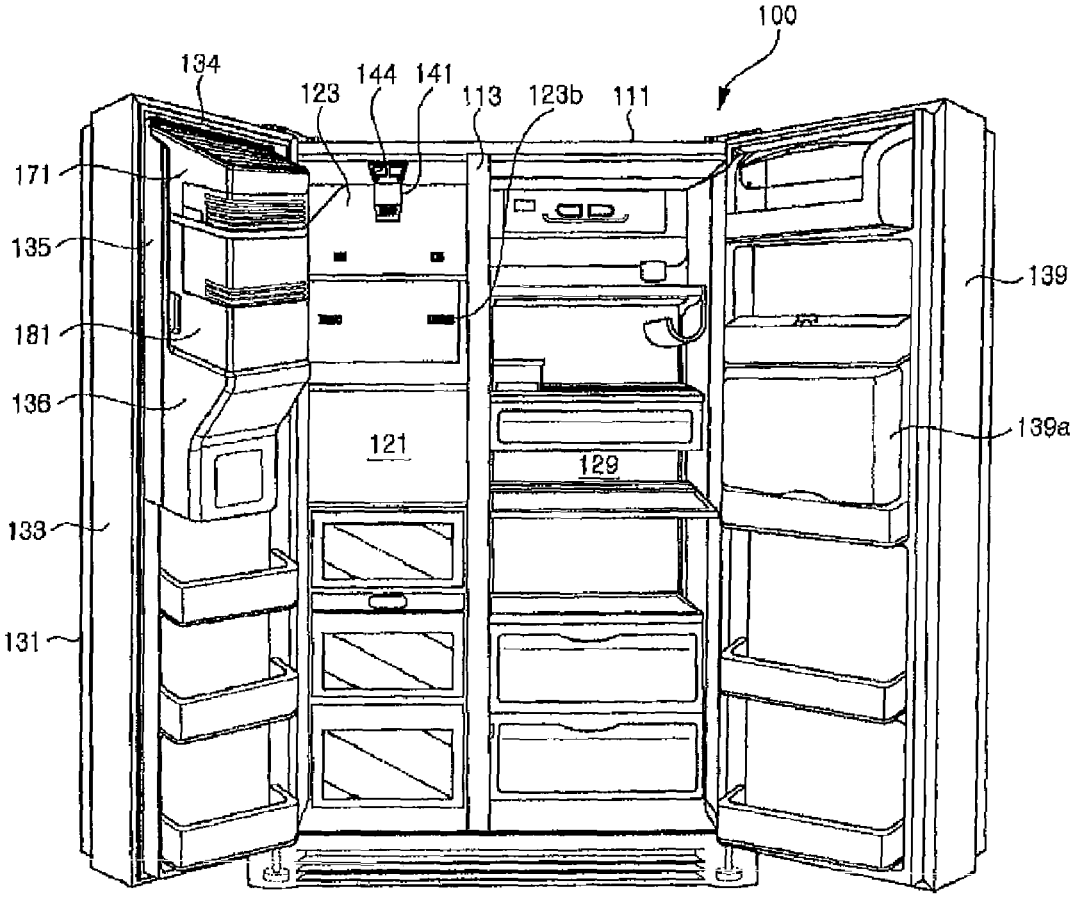
FIG. 2 is a perspective view illustrating a refrigerator that is provided with a preferred embodiment of an ice-making device for a refrigerator according to the present invention.
Figure 3:
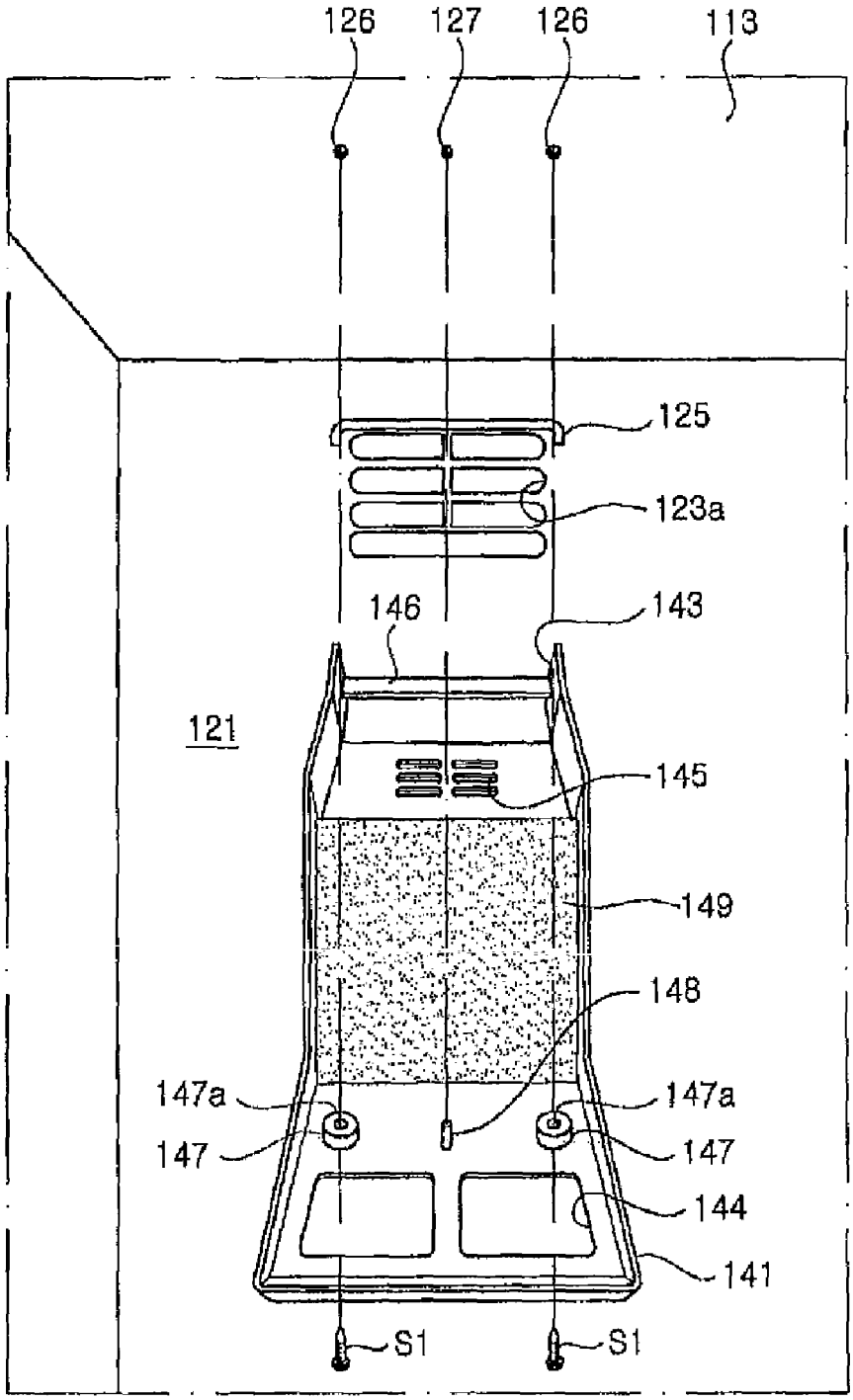
FIG. 3 is an exploded perspective view illustrating a major portion of the embodiment shown in FIG. 2.
Figure 4:
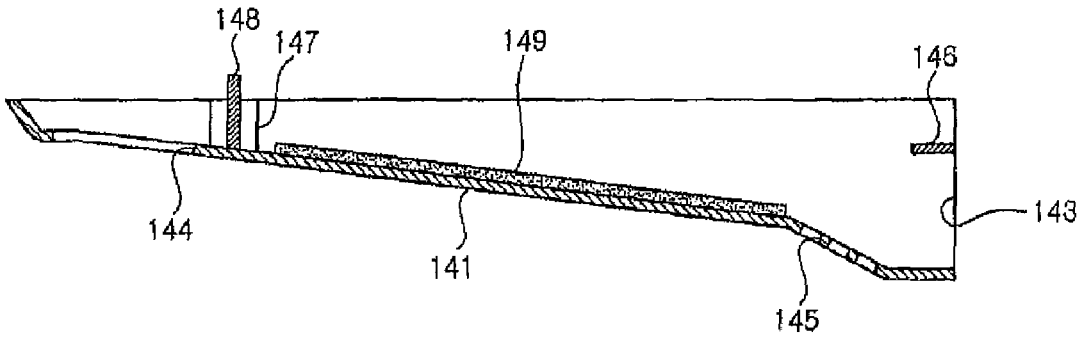
FIG. 4 is a side sectional view illustrating a cold air duct constituting the embodiment shown in FIG. 2.
Figure 5:
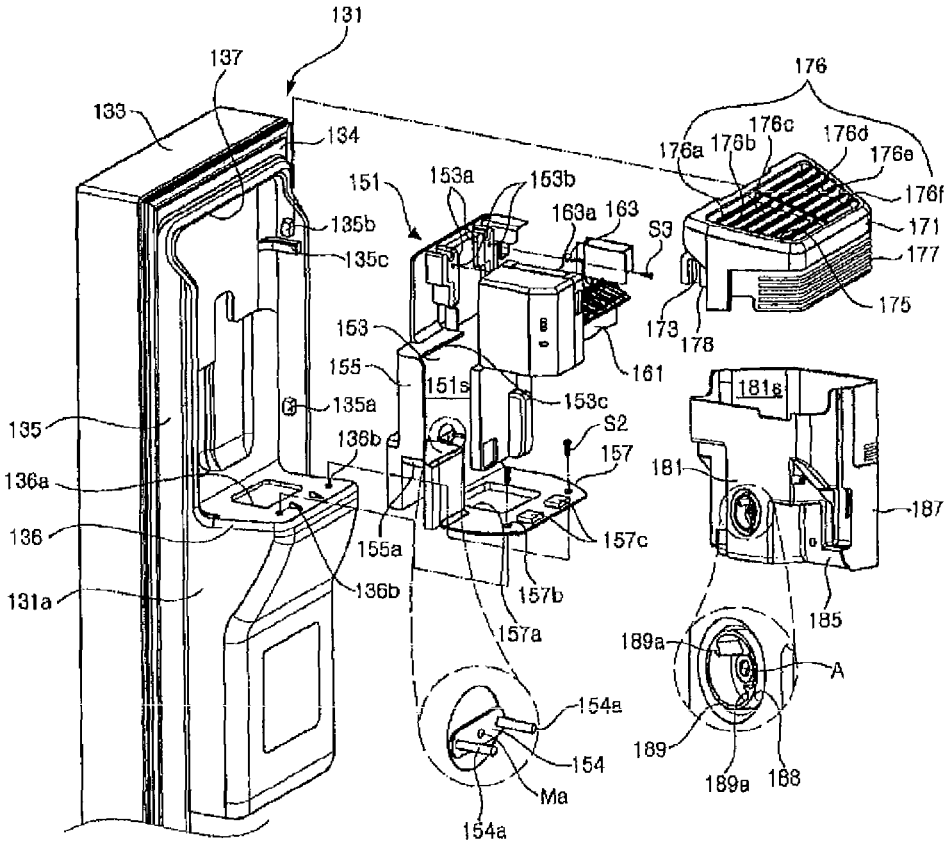
FIG. 5 is an exploded perspective view illustrating another major portion of the embodiment shown in FIG. 2.
Figure 6:
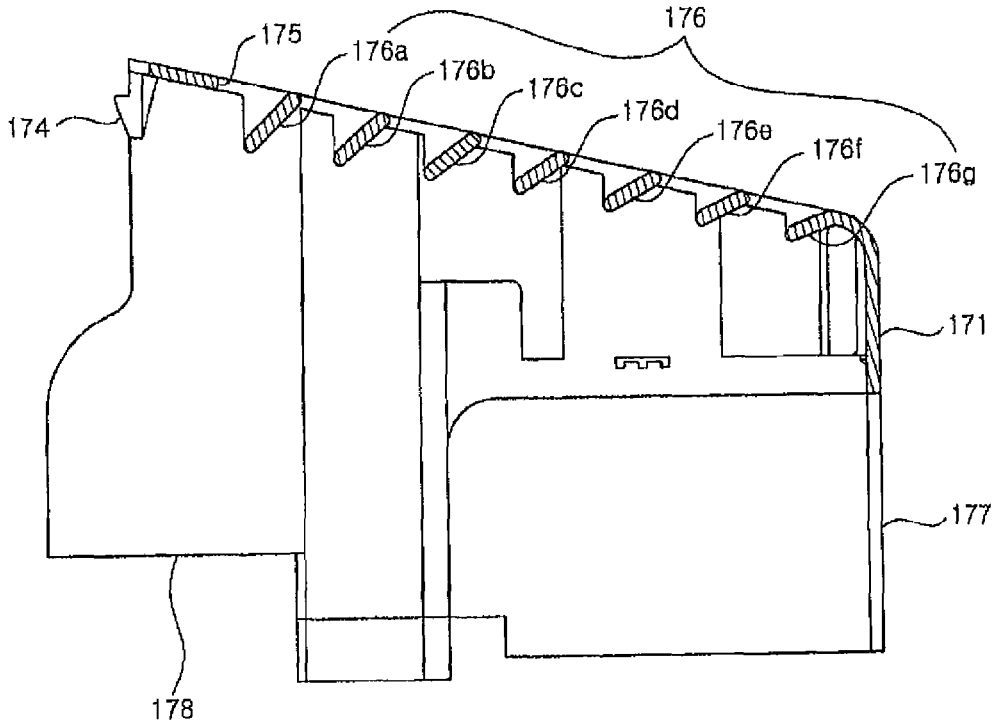
FIG. 6 is a side sectional view illustrating an ice maker cover constituting the embodiment shown in FIG. 2.
Figure 7:
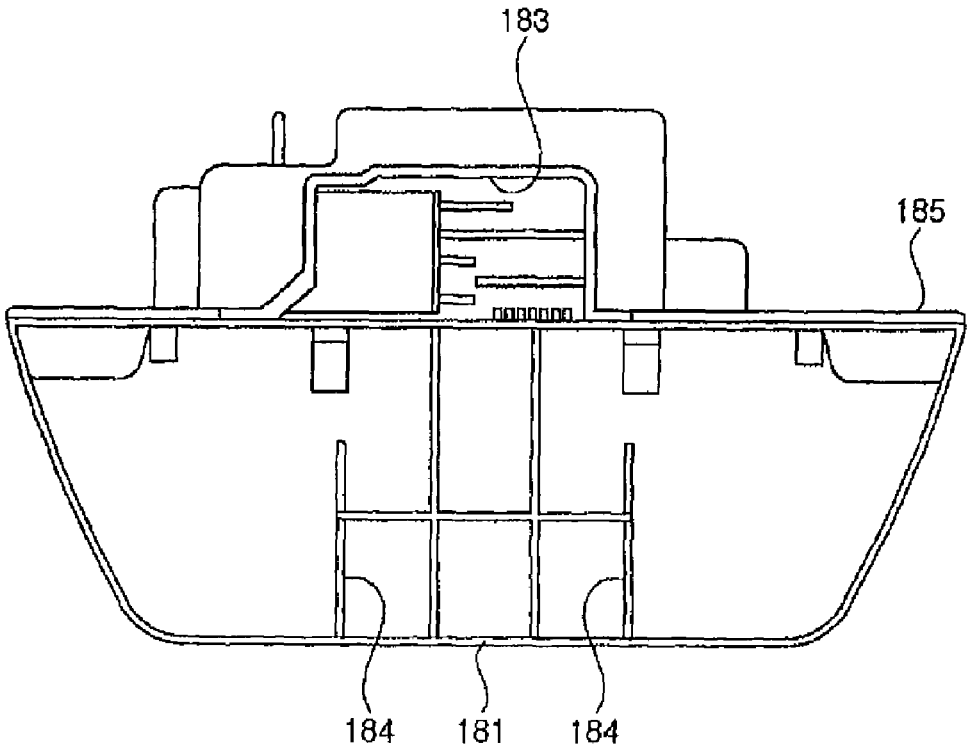
FIG. 7 is a plan view illustrating the underside of an ice bank constituting the embodiment shown in FIG. 2.

FIG. 2 illustrates a refrigerator that is provided with a preferred embodiment of an ice-making device for a refrigerator according to the present invention, FIG. 3 illustrates a major portion of the embodiment shown in FIG. 2, FIG. 4 illustrates a cold air duct constituting the embodiment shown in FIG. 2, FIG. 5 illustrates another major portion of the embodiment shown in FIG. 2, and FIGS. 6 and 7 illustrate an ice maker cover and an ice bank constituting the embodiment shown in FIG. 2.

As illustrated in the figures, a freezing chamber 121 and a refrigerating chamber 129 are provided in a refrigerator main body 100 so that they stand side by side. Furthermore, an outer case 111 defines the external appearance of the main body 100. An inner case 113 defining the inside of the main body 100 is coupled to the inside of the outer case 111. That is, the freezing chamber 121 and the refrigerating chamber 129 are defined by the inner case 113.

Meanwhile, a freezing chamber door 131 and a refrigerating chamber door 139 are provided on the main body 100. Each of the freezing chamber door 131 and the refrigerating chamber door 139 is installed to be pivotable on one end thereof so that a leading end thereof is moved in the fore and aft direction. The freezing chamber door 131 and the refrigerating chamber door 139 serve to selectively open or close the freezing chamber 121 and the refrigerating chamber 129, respectively.

Furthermore, the freezing chamber door 131 and the refrigerating chamber door 139 are provided with a dispenser 131*a* and a home-bar 139*a*, respectively. The dispenser 131*a* is to enable a user to take out water or ice from the outside without opening the freezing chamber door 131. The home-bar 139*a* is to enable a user to take out a beverage from the outside without opening the refrigerating chamber door 139.

A shroud 123 is provided in the freezing chamber 121. At this time, the backside of the shroud 123 is spaced apart from the rear side of the freezing chamber 121 by a predetermined distance. Furthermore, a heat exchange chamber 124 (see FIG. 8), in which an evaporator (not shown), an air-blowing fan (not shown) and the like are installed, is defined between the rear side of the freezing chamber 121 and the backside of the shroud 123.

Meanwhile, a plurality of cold air discharge holes 123*a* and 123*b* are formed in the shroud 123. The cold air discharge holes 123*a* and 123*b* are portions through which cold air heat-exchanged in the evaporator is discharged into the freezing chamber 121 by driving the air-blowing fan. The cold air discharge holes 123*a* and 123*b* are formed in the shroud 123 so that they are vertically or laterally spaced apart from each other.

As illustrated in FIG. 3 in detail, a fastening rib 125 is provided on the front side of the shroud 123 above the cold air discharge hole 123*a*, which is positioned in the uppermost part of the freezing chamber 121, among the cold air discharge holes 123*a* and 123*b*. The fastening rib 125 protrudes from the front side of the shroud 123 in the forward direction and is provided to extend from side to side. At this time, it is preferred that both ends of the fastening rib 125 be round to be inclined downwardly.

Meanwhile, the ceiling of the freezing chamber 121 is formed with a pair of fastening holes 126 and a fastening recess 127. The fastening holes 126 and the fastening recess 127 of the freezing chamber 121 are provided in the front end of the ceiling of the freezing chamber 121 corresponding to the front of the cold air discharge hole 123*a* and the fastening rib 125. At this time, it is preferred that the fastening recess 127 of the freezing chamber 121 be provided between the fastening holes 126 of the freezing chamber 121.

The ceiling of the freezing chamber 121 is provided with a cold air duct 141. The cold air duct 141 causes a portion of cold air discharged through the cold air discharge hole 123*a* to flow toward the backside of the freezing chamber door 131, and thus, serves to substantially supply the cold air to an ice maker 161, which will be described later.

To this end, the cold air duct 141 is formed to extend in the longitudinal direction and to have a side cross section of a "U" shape with the top portion opened. Hence, a flow passage, in which cold air supplied to the ice maker 161 substantially flows, is defined by the ceiling of the freezing chamber 121 and the inside of the cold air duct 141.

As illustrated in FIG. 4, it is preferred that the height of the cold air duct 141 be gradually increased from the front end thereof to the rear end thereof. That is, the cold air duct 141 is inclined at a predetermined slope downwardly from its front end to its rear end. Furthermore, the height of the rear end of the cold air duct 141 is relatively larger than at least the overall height of the cold air discharge hole 123*a*.

The cold air duct 141 is installed on the ceiling of the freezing chamber 121 to extend in the fore and aft direction. At this time, the rear end of the cold air duct 141 is brought into contact with the front side of the shroud 123 so that the cold air discharge hole 123*a* is positioned in the cold air duct. In addition, the front end of the cold air duct 141 is positioned adjacent to the front end of the ceiling of the freezing chamber 121.

A cold air inlet 143 is formed in the rear end of the cold air duct 141. The cold air inlet 143 serves as an inlet through which cold air discharged through the cold air discharge hole 123*a* is introduced into the cold air duct 141.

Further, a cold air outlet 144 is formed in the front end of the cold air duct 141. The cold air outlet 144 serves as an outlet through which cold air introduced into the cold air duct 141 through the cold air inlet 143 is discharged to be introduced into a cold air introduction hole 175 of an ice maker cover 171, which will be described later. However, as described above, the height of the cold air duct 141 is gradually increased from its front end to its rear end. Hence, the cold air outlet 144 is downwardly inclined toward the front of the freezing chamber 121.

Moreover, an auxiliary cold air outlet 145 is provided in the rear end of the cold air duct 141 adjacent to the cold air inlet 143. The auxiliary cold air outlet 145 serves to discharge a portion of cold air, which is introduced into the cold air duct 141 through the cold air discharge hole 123*a*, into the freezing chamber 121.

Meanwhile, a support rib 146 is provided on the inside of the rear end of the cold air duct 141. The support rib 146 is formed on the rear end of the cold air duct 141 to extend from side to side. Furthermore, in a state where the cold air duct 141 is installed on the ceiling of the freezing chamber 121, the bottom of the support rib 146 is supported on the top side of the fastening rib 125.

In addition, a pair of fastening bosses 147 are provided on the inside of the front end of the cold air duct 141 corresponding to the front of the cold air outlet 144. The fastening bosses 147 protrude upwardly from the inside of the front end of the cold air duct 141, so that leading ends of the fastening bosses are brought into contact with the ceiling of the freezing chamber 121. The fastening bosses 147 are laterally spaced apart from each other by a predetermined distance. Furthermore, a through hole 147*a*, through which a fastening screw S1 to be fastened to the fastening hole 126 of the freezing chamber 121 passes, is formed in each of the fastening bosses 147.

A fastening protrusion 148 is provided on the inside of the front end of the cold air duct 141 between the fastening bosses 147. The fastening protrusion 148 protrudes upwardly from the inside of the front end of the cold air duct 141. At this time, the fastening protrusion 148 is formed longer than the fastening boss 147 and is thus inserted into the fastening recess 127 of the freezing chamber 121.

An insulating material 149 is provided on an inner surface of the cold air duct 141. The insulating material 149 is provided on the inner surface of the cold air duct 141 between the cold air outlet 144 and the auxiliary cold air outlet 145. The insulating material 149 serves to prevent a phenomenon that the inside of the cold air duct 141 is frozen by cold air flowing into the cold air duct 141 through the cold air inlet 143.

It is preferred that the insulating material 149 be formed of polyethylene foam. This is to enable the thickness of the insulating material 149 to have a thickness of 3 mm or less, thereby maximizing the amount of cold air flowing to the ice maker 161 through the cold air duct 141. However, the insulating material 149 is not limited thereto but may be formed of general Styrofoam.

Meanwhile, as illustrated in FIG. 5 in detail, an outer door 133 defines the front external appearance of the freezing chamber door 131. In addition, a door liner 134 defining the rear external appearance of the freezing chamber 131 is coupled to the inside of the outer door 133.

Moreover, support steps 135 are respectively provided on both side ends of the backside of the freezing chamber door 131. A portion of the door liner 134 protrudes rearward by a predetermined length, so that each support step 135 is formed to vertically extend. A plurality of fixing protrusions 135*a* and 135*b* are provided at their corresponding positions on side surfaces of the support steps 135 facing each other.

Further, play prevention ribs 135*c* are provided on opposite sides of the support steps 135 which face with each other. The play prevention ribs 135*c* are positioned at corresponding positions so that they are downwardly spaced apart by a predetermined distance from the fixing protrusion 135*b* of the locking protrusions 135*a* and 135*b* that is provided in a relatively upper part of the support step 135. The play prevention ribs 135*c* are provided to be elongated in a horizontal direction on the opposite sides of the support steps 135.

Furthermore, a seating step 136 is provided on the backside of the freezing chamber 131. The seating step 136 is formed in such a manner that a portion of the door liner 134 between the support steps 135 protrudes rearward by a predetermined length. At this time, the seating step 136 protrudes relatively longer than the support step 135. In addition, the seating step 136 is substantially formed by installing the dispenser 131*a*.

In the meantime, a communication hole 136*a* is provided in the seating step 136. The communication hole 136*a* of the seating step 136 is formed in such a manner that a portion of the seating step 136 is cut away. The communication hole 136*a* of the seating step 136 is to supply the ice made in the ice maker 161 to the dispenser 131*a*. Furthermore, a pair of fastening holes 136*b* are formed in the front end of the seating step 136.

Moreover, the backside of the freezing chamber door 131 is provided with a connection step 137. The connection step 137 is formed to extend in such a manner that a portion of the door liner 134 protrudes rearward by a predetermined length so as to laterally connect the upper ends of the support steps 135.

A seating member 151 is provided on the backside of the freezing chamber door 131. The seating member 151 is formed in the shape of a polyhedron with a portion opened to have a predetermined installation space 151S provided therein. That is, the seating member 151 includes a front plate 153 defining the front side of the installation space 151S, both side plates 155 defining both side surfaces of the installation space 151S, and a bottom plate 157 defining the bottom surface of the installation space 1518. The backside of the front plate 153 is brought into contact with the backside of the freezing chamber door 131 between the support steps 135. Outer surfaces of both the side plates 155 are respectively brought into contact with the side surfaces of the support steps 135 facing each other. Furthermore, the underside of the bottom plate 157 is brought into contact with the top side of the seating step 136.

The front side of the installation space 151S is provided with cold air guides 153*a*. The cold air guides 153*a* are to guide a portion of cold air, which is supplied to the ice maker 161 by the cold air duct 141, to a space between the installation space 151S and the ice maker 161. The cold air guides 153*a* are configured in a pair to be provided in the upper portion of the front side of the installation space 151S to vertically extend and to be laterally spaced apart from each other by a predetermined distance. In the illustrated embodiment the cold air guides 153*a* are formed in such a manner that a portion of the front plate 153 defining the front side of the installation space 151S protrudes forward.

Furthermore, a pair of fastening holes 153*b* are formed in the front side of the installation space 151S. It is preferred that the fastening holes 153*b* be formed in the upper portion of the front side of the installation space 151S corresponding to one side of the cold air guide 153*a*.

Moreover, a catching rib 153*c* is provided on the front side of the installation space 151S. The catching rib 153*c* is formed in such a manner that a portion of the front plate 153 protrudes forward. In a state where an ice bank 181 to be described later is installed in the installation space 151S, the catching rib 153*c* is positioned on a trace that is formed by the upper end of the ice bank 181 upon rotating of the upper end of the ice bank 181 about the lower end thereof in the direction in which the upper end becomes spaced apart from the front side of the installation space 151S.

Although not shown, various components for operating the dispenser 131*a* and the ice-making device are installed in a space between the backside of the freezing chamber door 131 and the backside of the seating member 151, i.e., the backside of the front plate 153. In this space, there is provided, for example, a motor 152 that provides a driving force for use in feeding and crushing ice stored in the ice bank 181.

Furthermore, a motor shaft Ma of the motor 152 penetrates one side of the front lower part of the installation space 151S and is positioned within the installation space 151S. Moreover, a driving connector 154 is installed on the motor shaft Ma. The driving connector 154 is driven by the motor 152 and thus rotates about the motor shaft Ma.

The driving connector 154 is formed to have a predetermined length. Further, interlocking protrusions 154*a* are provided at both ends of one side of the driving connector 154. The interlocking protrusion 154*a* is formed in the shape of a cylinder vertically extending from the one side of the driving connector 154 and protrudes into the installation space 153. Since the interlocking protrusion 154*a* is formed in the cylindrical shape as above, it is possible to prevent the body of a user from being damaged by the interlocking protrusions 154*a* even in such a state where the ice bank 181 is removed from the installation space 151S.

Meanwhile, fixing recesses 155*a* are formed in the outsides of both sides of the seating member 151 corresponding to the outsides of both sides of the installation space 151S, respectively. The fixing recess 155*a* of the seating member 151 is formed in an approximately "U" shape opened downwardly. The fixing protrusion 135*a* of the support step 135 is inserted into the fixing recess 155*a* of the seating member 151. Hence, if the seating member 151 is moved downwardly from the top, the fixing protrusion 135*a* of the support step 135 is inserted into the fixing recess 155*a* of the seating member 151, and thus, the seating member 151 is fastened to the backside of the freezing chamber door 131.

A communication hole 157*a* is provided in the bottom side of the installation space 151S. The communication hole 157*a* of the installation space 151S communicates with the communication hole 136*a* of the seating step 136. Hence, the ice passing through the communication hole 157*a* of the installation space 151S and the communication hole 136*a* of the seating step 136 is taken out to the outside through the dispenser 131*a*. The communication hole 157*a* of the installation space 151S is formed in such a manner that a portion of the bottom plate 157 corresponding to the bottom side of the installation space 151S is cut away.

In addition, a pair of through holes 157*b* are formed in the front end of the bottom side of the installation space 151S. The through hole 157*b* of the installation space 151S is a hole through which a fastening screw S2 to be fastened to the fastening hole 136*b* of the seating step 136 passes. Moreover, a pair of catching protrusions 157*c* are provided in the front end of the bottom side of the installation space 1518. Each of the catching protrusions 157*c* is formed in such a manner that a portion of the bottom plate 157 corresponding to the bottom side of the installation space 151S protrudes upwardly.

The ice maker 161 is provided on the upper part of the installation space 151S. The ice maker 161 serves to make ice to be taken out to the outside through the dispenser 131*a*. A pair of mounting brackets 163 are provided on one side of the ice maker 161. Each of the mounting brackets 163 is formed with a through hole 163*a*. A fastening screw S3 penetrating the through hole 163*a* of the ice maker 161 is fastened to the fastening hole 153*b* of the installation space 151S so that the ice maker 161 is fastened to the installation space 151S.

Meanwhile, an ice maker cover 171 is detachably installed in the upper part of the installation space 151S. The ice maker cover 171 serves to selectively open or close the ice maker 161 and to allow cold air supplied through the cold air duct 141 to be transferred to the ice maker 161. Hence, in a state where the ice maker cover 171 is installed in the installation space 151S, the ice maker 161 is substantially positioned in the ice maker cover 171.

The ice maker cover 171 is formed in the shape of a polyhedron having the open lower side and one open side adjacent to the backside of the freezing chamber 131. Furthermore, fixing recesses 173 are formed in the outsides of both sides of the ice maker cover 171, respectively. The fixing recess 173 of the ice maker cover 171 is formed in a "U" shape opened downwardly. The fixing protrusion 135*b* of the support step 135 is inserted into the fixing recess 173 of the ice maker cover 171.

In addition, as illustrated in FIG. 6, a fastening hook 174 is provided on the rear side of the ice maker cover 171 that is brought into contact with the front side of the installation space 151S. The fastening hook 174 is formed to have predetermined elasticity, so that the ice maker cover 171 is elastically fastened to the connection step 137 in a state where the ice maker cover 171 is installed in the installation space 151S.

Meanwhile, the height of the ice maker cover 171 is gradually increased from the rear end thereof adjacent to the backside of the freezing chamber door 131 toward the front end thereof. Hence, the top side of the ice maker cover 171 is inclined downwardly at the same slope as the cold air duct 141 from the rear end thereof adjacent to the backside of the freezing chamber door 131 toward the front end thereof. That is, the cold duct 141 and the ice maker cover 171 are shaped to mate with each other. Accordingly, in a state where the freezing chamber door 131 closes the freezing chamber 121, the cold air duct 141 and the ice maker cover 171 are positioned adjacent to each other.

A cold air introduction hole 175 is formed in the top side of the ice maker cover 171. The cold air introduction hole 175 serves as an inlet into which cold air supplied through the cold air outlet 144 of the cold air duct 141 is introduced. In a state where the freezing chamber door 131 closes the freezing chamber 121, the cold air introduction hole 175 is formed in a position communicating with the cold air inlet 143 to have a size and shape corresponding to the cold air inlet 143.

The cold air introduction hole 175 is provided with a plurality of blades 176. The blades 176 serve to guide cold air, which is introduced through the cold air introduction hole 175, to the ice maker 161. Each of the blades 176 is inclined at a predetermined angle with respect to the vertical axis so as to guide cold air toward the ice maker 161 along the shortest route. Hence, an inclination angle of the blade 176 varies depending on a distance from the ice maker 161 and a position relative thereto.

For example, among the blades 176, the first blade 176*a* most adjacent to the ice maker 161 has an inclination angle of 45 degrees with respect to the vertical axis. Furthermore, among the blades 176, the seventh blade 176*g* furthest spaced from the ice maker 161 has an inclination angle of 70 degrees with respect to the vertical axis. Meanwhile, the second to sixth blades 176*b*, 176*c*, 176*d*, 176*e* and 176*f* positioned between the first blade 176*a* and the seventh blade 176*g* respectively have inclination angles that are gradually increased between 45 and 70 degrees with respect to the vertical axis as they become further away from the ice maker 161. That is, the second to sixth blades 176*b*, 176*c*, 176*d*, 176*e* and 176*f* have inclination angles of 49, 53, 57, 61 and 65 degrees with respect to the vertical axis, respectively.

In addition, the ice maker cover 171 is provided with a viewing window 177. The viewing window 177 of the ice maker cover 171 is formed of a transparent or translucent material. The viewing window 177 of the ice maker cover 171 is to view the process of making ice in the ice maker 161 with the naked eye in a state where a user does not detach the ice maker cover 171.

Play prevention steps 178 are formed at lower ends of both side surfaces of the ice maker cover 171. The play prevention step 178 is positioned below the fixing recess 173 of the ice maker cover 171. When the ice maker cover 171 is installed in the installation space 151S, the play prevention step 178 is seated on the top side of the play prevention rib 135*c*. In this way, the fixing protrusion 135*a* is inserted into the fixing recess 173 of the ice maker cover 171, and the play prevention step 178 is seated on the play prevention rib 135*c*, thereby preventing a phenomenon that the ice maker cover 171 plays partly in an up and down direction in a state where it is installed in the installation space 151S.

Referring to FIG. 5 again, the ice bank 181 is detachably installed to the lower part of the installation space 151S below the ice maker 161 and the ice maker cover 171. The ice made in the ice maker 161 is stored in the ice bank 181. Furthermore, the ice bank 181 transfers the stored ice to the dispenser 131*a* so as to enable a user to take out the ice from the outside.

The ice bank 11S is formed in the shape of a polyhedron having the same cross section as the ice maker cover 171. Furthermore, a storage space 181S of a hopper shape with an upper part opened is provided in the ice bank 181. The storage space 181S stores the ice made in the ice maker 161.

As illustrated in FIG. 7, an ice feeding opening 183 is provided in the underside of the ice bank 181. The ice feeding opening 183 serves as an outlet for transferring the ice stored in the storage space 181S to the dispenser 131*a*. That is, the ice stored in the storage space 181S is transferred to the dispenser 131*a* through the ice feeding opening 183, the communication hole 157*a* of the installation space 151S and the communication hole 136*a* of the seating step 136.

Meanwhile, an ice-releasing means 182 for feeding the ice stored in the storage space 181S to the dispenser 131*a* through the ice feeding opening 183 is provided in the ice bank 181. Further, an ice-crushing means 186 for crushing ice, which is fed to the dispenser 131*a*, according to user's selection is provided in the ice bank 181.

Moreover, a pair of catching recesses 184 are formed in the underside of the ice bank 181. The catching protrusions 157*c* are respectively inserted into the catching recesses 184. Hence, the ice bank 181 does not move inadvertently in the fore and aft direction of the installation space 151S in a state where the ice bank 181 is installed in the installation space 151S.

In addition, in a state where the ice bank 181 is installed in the installation space 151S, the upper end circumference of the ice bank 181 is spaced apart by a predetermined distance from the underside of the ice maker 161 and the lower end circumference of the ice maker cover 171. At this time, a gap between the lower end circumference of the ice maker cover 171 and the underside of the ice maker 161 and the upper end circumference of the ice bank 181 is designed to be relatively smaller than the height of the catching protrusion 157*c*. Furthermore, the rear side of the ice bank 181 is spaced apart from the front side of the installation space 151S by a predetermined distance.

This is to prevent the ice bank 181 from being inadvertently detached from the installation space 51S. That is, in a state where the ice maker 161 and the ice maker cover 171 are installed in the installation space 151S, the ice bank 181 cannot be moved vertically. Furthermore, since the catching protrusions 157*c* are inserted in the catching recesses 184, the ice bank 181 cannot also be moved in the fore and aft direction or the left and night direction.

Hence, in order to detach the ice bank 181 from the installation space 151S, the ice bank 181 is moved to be upwardly inclined in a state where the upper end of the rear side thereof is rotated to be adjacent to the front side of the installation space 151S, and then, the catching protrusions 157*c* are separated from the catching recesses 184. At this time, the ice bank 181 is moved until the upper end of the rear side thereof is brought into contact with one portion of the front side of the installation space 151S, and more specifically, a portion adjacent to an edge defined by the rear end of the underside of the ice maker 161 and the front side of the installation space 151S. In addition, the ice bank 181 is horizontally moved to be spaced apart from the front side of the installation space 151S, whereby the ice bank 181 can be detached from the installation space 151S. Furthermore, the ice bank 181 can be installed in the installation space 151S in the reverse order.

A round portion 185 is provided in the lower end of the rear side of the ice bank 181. The round portion 185 causes the ice bank 181 to be easily rotated about the lower end thereof in the direction in which the upper end of the rear side of the ice bank 181 becomes adjacent to the front side of the installation space 151S so that the ice bank 181 is mounted to or detached from the installation space 151S.

Meanwhile, a shock can be generated in the process of rotating the freezing chamber door 131. However, since the lower end of the ice bank 181 is restricted from moving due to the catching protrusion 157*c* and the catching recess 184, the ice bank 181 is rotated about the lower end thereof. That is, the ice bank 181 is rotated about the lower end thereof in the direction in which the upper end of the ice bank 181 becomes adjacent to or spaced apart from the front side of the installation space 1518.

However, the ice bank 181 is installed so that the rear side thereof is spaced apart from the front side of the installation space 151S by a predetermined distance. Hence, in the process of rotating the freezing chamber door 131, although the ice bank 181 is rotated about the lower end thereof in the direction in which the upper end thereof becomes adjacent to the front side of the installation space 151S, the ice bank 181 is not detached from the installation space 151S.

Furthermore, the upper end of the rear side of the ice bank 181 is positioned adjacent to the catching rib 153*c*. Hence, although the ice bank 181 is rotated about the lower end thereof in the direction in which the upper end thereof becomes spaced apart from the front side of the installation space 151S, the upper end of the rear side of the ice bank 181 is caught to the catching rib 153*c*, and thus, the ice bank 181 is not detached from the installation space 151S inadvertently.

In addition, the ice bank 181 is provided with a viewing window 187. The viewing window 187 of the ice bank 181 is formed of a transparent or translucent material like the viewing window 177. Moreover, a user can identify an amount of the ice stored in the storage space 181S through the viewing window 187 of the ice maker cover 171.

Meanwhile, an installation recess 188 is formed in the lower part of the rear side of the ice bank 181. The installation recess 188 of the ice bank 181 is formed at a position corresponding to the driving connector 154. The installation recess 188 of the ice bank 181 is formed to be recessed inwardly such that a portion of the rear side of the ice bank 181 has a circular cross section.

One end of a rotational shaft A is positioned in the installation recess 188 of the ice bank 181. The other end of the rotational shaft A extends into the ice bank 181. Furthermore, the ice-releasing means 182 and the ice-crushing means 186 are coupled to the rotational shaft A extending into the ice bank 181. Hence, if the rotational shaft A is rotated, the ice-releasing means 182 and the ice-crushing means 186 are operated so that ice stored in the storage space 181S is fed to the dispenser 131*a* or is crushed.

Furthermore, an interlocking connector 189 is installed in the installation recess 188 of the ice bank 181. The interlocking connector 189 is installed to be rotatable about the rotational shaft A. The interlocking connector 189 is formed in the shape of a cylinder having a diameter relatively smaller than the dimension of the installation recess 188 of the ice bank 181.

A pair of interlocking ribs 189*a* are provided on an inner circumferential surface of the interlocking connector 189. The interlocking ribs 189*a* protrude from both sides of the inner circumferential surface of the interlocking connector 189 by a predetermined length in a direction in which they face each other. Hence, the interlocking rib 189*a* is substantially positioned in the installation recess 188 of the ice bank 181. In a state where the ice bank 181 is installed in the lower part of the installation space 151S, the interlocking rib 189*a* is engaged with the interlocking protrusion 154*a* and thus serves to rotate the interlocking connector 189 in cooperation with the rotation of the driving connector 154.

Hereinafter, the operation of an ice-making device for a refrigerator according to the preferred embodiment of the present invention will be described in detail with reference to the accompanying drawings.

Figure 8:
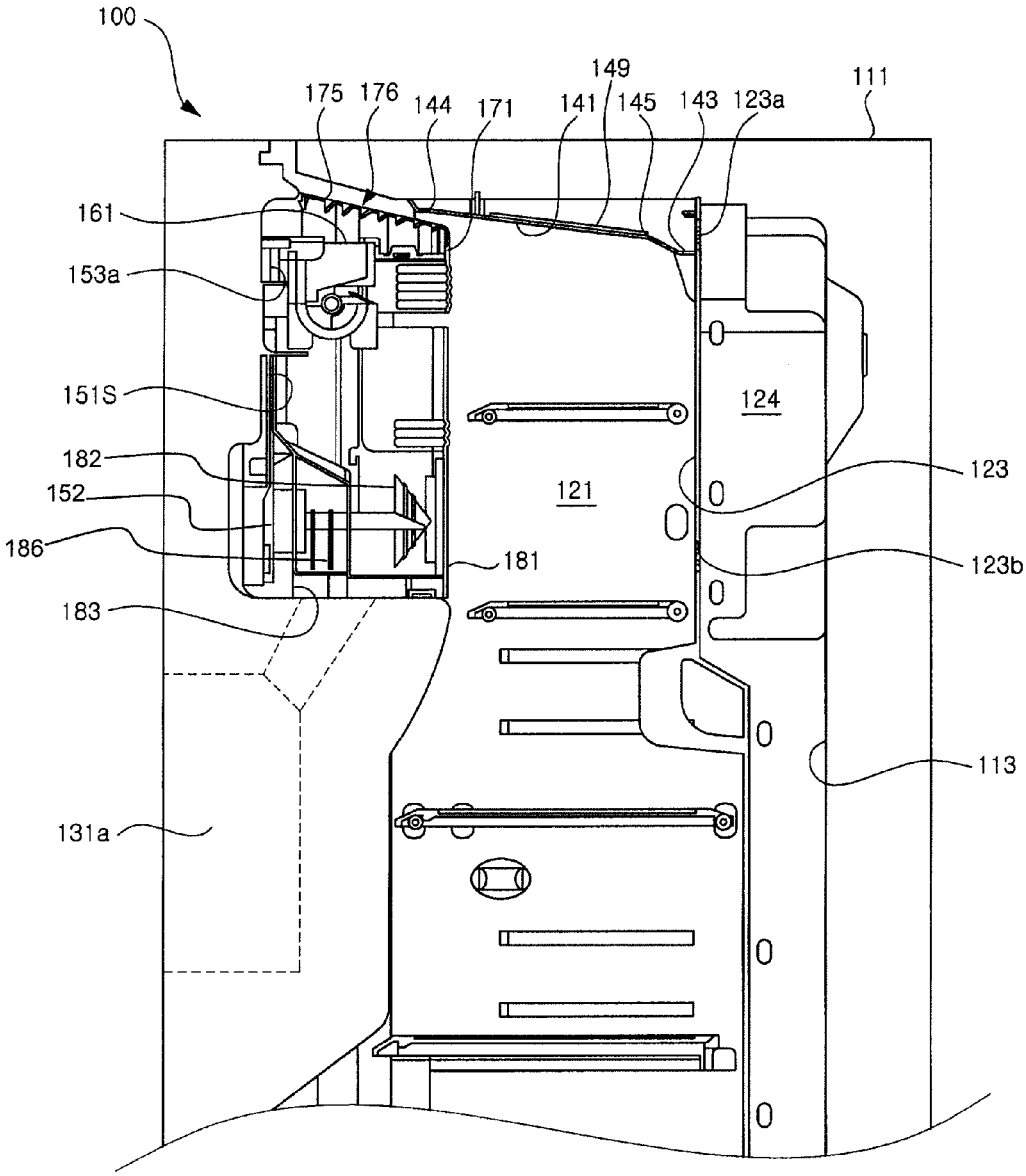
FIG. 8 is a side sectional view illustrating a process of flowing cold air and a process of feeding ice in the embodiment shown in FIG. 2.

FIG. 8 illustrates a process of flowing cold air and a process of feeding ice in the preferred embodiment of the ice-making device for a refrigerator according to the present invention.

As illustrated in the figure, when the air-blowing fan is driven, the cold air, which is heat-exchanged in the evaporator provided in the heat exchange chamber 124, is discharged into the freezing chamber 121 through the cold air discharge holes 123*a* and 123*b*. Then, the cold air discharged through any one, e.g., the cold air discharge hole 123*a*, of the cold air discharge holes 123*a* and 123*b* is introduced into the cold air duct 141 through the cold air inlet 143.

A portion of the cold air introduced into the cold air duct 141 is supplied into the freezing chamber 121 through the auxiliary cold air outlet 145. Then, the remaining cold air introduced into the cold air duct 141 is discharged through the cold air outlet 144 and then supplied to the ice maker 161 positioned in the ice maker cover 171 through the cold air introduction hole 175.

In the meantime, the insulating material 149 is provided in the cold air duct 141. Hence, while cold air introduced into the cold air duct 141 through the cold air inlet 143 is discharged through the cold air outlet 144 and the auxiliary cold air outlet 145, it is possible to minimize a phenomenon that freezing occurs in the cold air duct 141.

In a state where the freezing chamber 121 is closed by the freezing chamber door 131, the cold air duct 141 and the ice maker cover 171 mate with each other in shape. Hence, the phenomenon is minimized that the cold air introduced into the cold air introduction hole 175 through the cold air outlet 144 flows out to the outside, i.e., to the inside of the freezing chamber 121. Furthermore, the cold air supplied to the ice maker 161 through the cold air introduction hole 175 is guided along the shortest route by the blades 176. Hence, the cold air is guided so as to be supplied to the ice maker 161 more efficiently by the blades 176.

In addition, a portion of the cold air guided by the blades 176 flows through a space between the front side of the installation space 151S and the ice maker 161 by the cold air guides 153*a*, and, then, is supplied to the ice maker 161. Hence, the cold air is also supplied smoothly to one side of the ice maker 161 corresponding to the opposite side to the cold air introduction hole 175.

Meanwhile, the ice made in the ice maker 161 is stored in the storage space 181S of the ice bank 181. Then, the ice is dispensed to the outside through the dispenser 131*a* by the manipulation of a user. At this time, the ice can be crushed into pieces having a predetermined size according to the user's selection.

More specifically, when the motor shaft Ma is rotated by means of driving of the motor 152, the driving connector 154 is rotated. Furthermore, when the driving connector 154 is rotated, the interlocking connector 189 of which the interlocking rib 189*a* is engaged with the interlocking protrusion 154*a* of the driving connector 154 is also rotated in cooperation with the rotation of the driving connector. Hence, the rotational shaft A that is coupled to the interlocking connector 189 is rotated.

Furthermore, when the rotational shaft A is rotated, the ice-releasing means 182 and the ice-crushing means 186 are operated. Hence, ice stored in the storage space 181S is taken out to the outside through the dispenser 131*a* in a made or crushed state.

It will be apparent that those skilled in the art can make various modifications thereto within the scope of the technical spirit of the invention. The true scope of the present invention should be interpreted by the appended claims.

INDUSTRIAL APPLICABILITY

According to the ice-making device for a refrigerator of the present invention so configured, the following advantages can be expected.

First, in the present invention, the ice maker is installed on the backside of the freezing chamber door. Hence, it is possible to prevent the phenomenon that a storage capacity of a storage space of a refrigerator, more particularly, a freezing chamber is lowered, thereby storing much more food in the freezing chamber.

Furthermore, according to the present invention, in a state where the ice maker is covered with the ice maker cover, a portion of the cold air supplied to the freezing chamber is supplied by the cold air duct, thereby making ice. Hence, in the process of making ice in the ice maker, it is possible to minimize the phenomenon that smell of other food stored in the freezing chamber permeates ice, whereby it is possible to make ice more hygienically.

In addition, according to the present invention, the ice bank that stores the ice made in the ice maker and transfers the ice to the dispenser is also installed on the backside of the freezing chamber door. Hence, it is possible to minimize the phenomenon that smell of other food permeates ice in a state where the ice is stored in the ice bank and at the same time to reduce the time required for supplying the ice through the dispenser.

In addition, according to the present invention, the fixing protrusion of the freezing chamber door is inserted into the fixing recess of the ice maker cover, and the play prevention step of the ice maker cover is seated on the play prevention rib of the freezing chamber door, thereby preventing a phenomenon that the ice maker plays partly in the up and down direction in a state where it is installed on the backside of the freezing chamber door. Hence, it is possible to prevent a phenomenon that the ice maker and the ice maker cover are damaged due to collision, thereby improving the durability of a product.

Furthermore, according to the present invention, the interlocking protrusion in the form of a cylinder is provided on the driving connector that is installed on the backside of the door so as to transmit a driving force to the ice-releasing means and the ice-crushing means provided in the ice bank. Hence, even though the ice bank is removed from the backside of the door, it is possible to prevent a user from being damaged by the interlocking protrusion, resulting in safer use of a product.

Moreover, according to the present invention, the insulating material is provided in the cold air duct. Hence, while cold air is supplied to the ice maker by the cold air duct, it is possible to minimize a phenomenon that freezing occurs in the cold air duct and thus, it is possible to use a refrigerator more cleanly.

The invention claimed is:

1. A refrigerator, comprising:

a main body having a storage chamber;

a door provided to the main body to selectively open or close the storage chamber, the door including:

an outer door defining a front external appearance of the door; and a door liner defining a rear external appearance of the door, the door liner including:

support steps vertically extending along both sides of the door liner;

a liner plate interconnecting the support steps; and a seating step horizontally extending from the door liner, the liner plate, the support steps and the seating step defining an installation space;

a seating member located at least partially in the installation space, the seating member including a front plate overlying a portion of the liner plate, the seating member being fastened to and separable from the door liner;

an ice maker mounted on the front plate of the seating member;

an ice bank removably located on the seating member, the ice bank serving to store and transfer ice to a dispenser;

a driving motor providing driving force for use in feeding and/or crushing ice stored in the ice bank;

a motor shaft penetrating the front plate of the seating member from the driving motor;

a driving connector operatively connected to the driving motor and rotatably installed in the seating member; and an interlocking connector rotatably provided to the ice bank and selectively connected to the driving connector, wherein the driving motor is installed between the backside of the door and the seating step, and the motor shaft is operatively connected to the driving connector.

2. The refrigerator according to claim 1, wherein the seating member includes a bottom surface, and the ice bank is configured to move generally horizontally along the bottom surface of the seating member.

3. The refrigerator according to claim 1, wherein the interlocking connector is configured to rotate with rotation of the driving connector when they are connected.

4. The refrigerator according to claim 1, wherein the ice bank includes an installation recess to receive the interlocking connector.

5. The refrigerator according to claim 4, wherein the ice bank further includes an ice-releasing means for feeding ice stored in the ice bank to the dispenser, wherein the interlocking connector is connected to an end of the ice-releasing means.

6. The refrigerator according to claim 5, wherein the ice bank further includes an ice-crushing means for crushing ice stored in the ice bank, wherein the interlocking connector is connected to an end of the ice-crushing means.

7. The refrigerator according to claim 1, wherein the driving connector comprises at least one interlocking protrusion rotating with the motor shaft, and the interlocking connector comprises at least one interlocking rib to be engaged with the interlocking protrusion.

8. The refrigerator according to claim 1, wherein the ice maker is installed in an upper portion of the installation space.

9. A refrigerator, comprising:

a main body having a storage chamber;

a door provided to the main body to selectively open or close the storage chamber, the door including:

an outer door defining a front external appearance of the door; and a door liner defining a rear external appearance of the door, the door liner including:

support steps vertically extending along both sides of the door liner;

a liner plate interconnecting the support steps; and a seating step horizontally extending from the door liner, the liner plate, the support steps and the seating step defining an installation space;

a seating member located at least partially in the installation space, the seating member including a front plate overlying a portion of the liner plate, the seating member being fastened to and separable from the door liner;

an ice maker mounted on the front plate of the seating member;

an ice bank removably located on the seating member, the ice bank serving to store and transfer ice to a dispenser;

a driving motor providing driving force for use in feeding ice stored in the ice bank;

a motor shaft penetrating the front plate of the seating member from the driving motor and operatively connected to the driving motor;

a rotational shaft extending into the ice bank; and an ice-releasing device in the ice bank and connected to the rotational shaft, whereby ice stored in the ice bank is released from the ice bank by rotation of the ice-releasing device.

10. The refrigerator according to claim 9, further comprising a connector for transmitting rotary power of the driving motor to the rotational shaft.

11. The refrigerator according to claim 10, wherein the connector comprises:

a driving connector operatively connected to the driving motor; and an interlocking connector connected to the rotational shaft.

12. The refrigerator according to claim 11, wherein the driving connector is configured to be engaged with the interlocking connector and transmit the rotary power of the driving motor to the interlocking connector.

13. The refrigerator according to claim 9, wherein the rotational shaft extends from a lower portion of the ice bank.

14. The refrigerator according to claim 9, wherein the seating member includes a bottom plate extending horizontally at a lower end of the seating member.

15. The refrigerator according to claim 14, wherein the seating member includes a communication opening located in the bottom plate for permitting ice to pass therethrough from the ice bank to the dispenser.

16. The refrigerator according to claim 9, wherein the ice bank is located at a lower portion of the seating member.

17. The refrigerator according to claim 16, wherein a cold air passage is located between the ice maker and the front plate of the seating member such that a portion of cold air supplied to the ice maker is introduced to the ice bank.

* * * * *